United States Patent [19]

Baumgartner et al.

[11] 4,089,629

[45] May 16, 1978

[54] PROCESS AND APPARATUS FOR CONTROLLED RECYCLING OF COMBUSTION GASES

[75] Inventors: Henri Baumgartner, Bernex; André Jacquemet, Grand-Lancy, both of Switzerland; John George Meier, San Diego, Calif.; Bernard Vollerin, Geneva, Switzerland

[73] Assignee: Pietro Fascione, Busto Arsizio (Varese), Italy

[21] Appl. No.: 656,079

[22] Filed: Feb. 6, 1976

[30] Foreign Application Priority Data

| | | |
|---|---|---|
| Feb. 12, 1975 | Switzerland | 1706/75 |
| Dec. 15, 1975 | Switzerland | 16208/75 |

[51] Int. Cl.[2] ..... F23M 3/00

[52] U.S. Cl. ..... 431/9; 431/116

[58] Field of Search ..... 431/9, 8, 12, 187, 171, 431/115, 159, 116

[56] References Cited

U.S. PATENT DOCUMENTS

| | | | |
|---|---|---|---|
| 2,058,089 | 10/1936 | Lundborg et al. | 431/8 |
| 2,180,190 | 11/1939 | Baro | 431/159 X |
| 2,721,735 | 10/1955 | Permann | 431/116 X |
| 3,021,892 | 2/1962 | Brola | 431/116 |
| 3,042,105 | 7/1962 | Bitterlich | 431/181 X |
| 3,097,686 | 7/1963 | Morrow | 431/115 X |
| 3,402,985 | 9/1968 | Galvin | 431/116 |
| 3,604,824 | 9/1971 | Hardison | 431/116 |
| 3,741,166 | 6/1973 | Bailey | 431/9 |
| 3,781,162 | 12/1973 | Rudd et al. | 431/115 |
| 3,820,943 | 6/1974 | DeLancey et al. | 431/187 X |
| 3,868,211 | 2/1975 | Haye et al. | 431/115 X |

*Primary Examiner*—Edward G. Favors
*Assistant Examiner*—Larry Jones
*Attorney, Agent, or Firm*—Karl F. Ross

[57] ABSTRACT

Formation of nitrogen oxides and/or soot is obviated by mixing recycled combustion gas with incoming comburant supplied to a burner via a distribution opening and controlling the mass flow rate of combustion gas being recycled with respect to the mass flow rate necessary for the gaseous comburant, the mixture being passed to the burner as a turbulent flow in which the ratio between the kinetic momentum flux of the mixture and the product of the radius of the said distribution opening times the axial movement quantity flux of the mixture has a value at least sufficient so that the said turbulent flow produces a recirculation of the said mixture within the combustion chamber in the form of a toroidal vortex. This is achieved by apparatus comprising a mixing enclosure having two inlets each provided with means for regulating the size of its aperture, and an outlet, inlets communicating respectively with the atmosphere and with a duct for combustion gases, the outlet being connected to the inlet of a ventilator whose outlet communicates with gas mixture supply means arranged coaxially to a fuel injection nozzle in order to impart a turbulent motion to the gas mixture emitted from the supply means.

7 Claims, 7 Drawing Figures

PROCESS AND APPARATUS FOR CONTROLLED RECYCLING OF COMBUSTION GASES

FIELD OF THE INVENTION

This invention relates to a method of controlling the combustion of a fluid fuel and to apparatus for use in that method.

BACKGROUND OF THE INVENTION

The formation of nitrogen oxides ($NO_x$) in the case of most fuels, and of soot in the case of liquid fuels, are two problems always associated with combustion chambers. These problems tend to be accompanied by flame instability. The production of soot which accompanies the combustion of liquid fuels seem at first blush to be incompatible with the formation of $NO_x$, since the former results from a deficiency of oxygen supplied by the air.

In order to deal with the problem of $NO_x$, much work has been carried out on the recirculation of combustion gases. The object of this recirculation is to reduce the excess of the air necessary for combustion while increasing the mass flow rate. The result of this is to provide a better utilization of the oxygen without increasing the production of nitrogen oxides ($NO_x$), which are a serious source of atmospheric pollution, and in general to provide the so-called "blue flame" combustion.

Of the solutions which have been proposed, one makes use of an air injection zone above or upstream of the fuel injection zone. This air injection zone is connected on the one hand to the fuel injection zone, and on the other hand to the combustion chamber. The air injected into the air injection zone causes a reduction in pressure, which draws the combustion gases from the chamber towards this zone and reinjects them, together with air, into the fuel injection zone. This solution has the disadvantage that a relatively long delay is necessary to obtain a satisfactory combustion. This delay is not tolerable, bearing in mind the frequent stopping and starting operations particularly in the case of a boiler.

Other solutions have been proposed to improve the combustion. One of these relates to the turbulent flow of the air feeding the burners and is generally known by the anglo-saxon expression "swirl". One chapter in the work of J. M. Beer and N. A. Chigier, "Combustion Aerodynamics", Applied Science Publishers Limited, London (1972) is devoted to this topic. This work shows in particular that the turbulent flow of the air around the fuel injection cone increases both the stability and luminosity of the flame, considerably alters the shape of the flame, which thus spreads very rapidly from the outlet of the fuel injection nozzle, and produces a high degree of mixing and turbulence. On the other hand, this improvement in the flame does not lead to sootless combustion, and is accompanied by a high level of noise due to the turbulence and the very high combustion rate. This noise level may even exceed the permissible limits.

Finally, there may also be mentioned an experiment which has been carried out on a gas burner in order to reduce the amount of $NO_x$. In accordance with the experiment, four pipes lead tangentially into a tubular chamber which is concentric with a gas inlet pipe. Air and combustion gases are passed under pressure so as to form a "swirl" around the nozzle. However, these experiments have not gone beyond the laboratory stage and appear to have come up against stability problems.

Furthermore, the laboratory prototype described does not appear to be easily applicable to industrial use.

The work which has been mentioned would seem to prove that it should be possible to perform combustion with a low rate of formation of $NO_x$ while approaching conditions of stoichiometric combustion, by virtue of the recirculation of the combustion gases on the one hand and the turbulent flow on the other hand. However, the solutions proposed do not in practice provide the combustion stability and cleanliness which ought theoretically to have been expected using recirculation techniques and turbulent flow.

The causes of this relative lack of success are doubtless many and varied. In the case of internal recirculation, the basic problem involves the delay in establishing a satisfactory combustion. The formation of a flow of combustion gas in the direction of the reduced pressure region in the air injection zone, upstream of the fuel injection nozzle, in fact takes a certain time to become established since the combustion gases in the combustion chamber are aspirated by the funnel on the one hand, and by the air injection zone on the other hand.

Another reason for this partial lack of success is manifested in a fairly high degree of flame instability, which is reflected in a fluctuating mode of combusion. Finally, the noise produced by yellow-flame combustion or by the turbulent type of flow may exceed the normally permissible level.

The instability of the flame is due to a large extent to a poor mixture of fuel and air and to insufficient dilution of the available oxygen. In order to obtain a satisfactory combustion, in particular one with a blue flame, the fuel if liquid must be atomized into sufficiently fine droplets. It is also necessary for the available oxygen to be sufficiently diluted in the gaseous mass formed from air and combustion gas. In fact, in order for the air excess to be reduced to a minimum and for the combustion thereby to approach stoichiometric conditions, it is necessary to ensure that each molecule of oxygen has a good probability of meeting a molecule of fuel. This is the reason why it is not sufficient to recirculate a certain amount of combustion gas: the oxygen must also be diluted in a homogeneous manner throughout the mass of gas.

In order to achieve this dilution it is desirable to use a gas whose partial pressure of oxygen is less than that of air, so as to exploit the greater part of the available oxygen, thereby leading to a reduction in the production of $NO_x$. However, the reinjection methods so far used have not ensured a sufficiently good dilution of the oxygen. Consequently, since the mass of gas does not have a constant partial pressure of oxygen in the reaction zone with respect to time, the combustion may not be uniform.

The stability of the flame cannot be guaranteed even by combining turublent flow and recirculation, doubtless for the same reason, namely an incomplete dilution of the available oxygen in the mass of gas.

OBJECT OF THE INVENTION

The object of the present invention is to obviate, at least in part, the disadvantage of the afore-mentioned solutions so as to ensure a blue flame combustion which is stable, produces a small quantity of $NO_x$, and generates less noise.

SUMMARY OF THE INVENTION

To this end, one feature of the present invention comprises a process for supplying a comburant to a fluid fuel burner whose comburant distribution opening opens into a combustion chamber, comprising the combination of steps in which:

a zone of reduced pressure is formed upstream of the burner;

this zone is connected to a source of gaseous comburant on the one hand, and to a pipe for removing the combustion gases on the other hand;

the mass flow rate of combustion is controlled with respect to the necessary mass flow rate of gaseous comburant;

the combustion gases are mixed with the gaseous comburant to reduce the oxygen concentration of the comburant mixture, and the mixture is introduced into the combustion chamber via the said distribution opening, while forming a turbulent flow in which the ratio between the kinetic momentum flux of the mixture on the one hand, and the product of the radius on the said distribution opening times the axial movement quantity flux of the mixture on the other hand, has a value at least sufficient so that the said turbulent flow produces a recirculation of the said mixture within the said chamber in the form of a toroidal vortex.

In a further feature of the invention, a part of the said mixture is withdrawn upstream of the distribution opening of the burner and this part of the mixture is led to the vicinity of the ejection orifice of the nozzle in order to prevent blockage of this orifice by products internally recirculated by the sid toroidal vortex.

The basic advantage of this process and the apparatus for carrying out the said process is the formation of a double recirculation, one being external via the aspiration of a certain mass of combustion gas and the mixing thereof with gaseous comburant, the other being internal in the form of a toroidal vortex of the comburant mixture induced by the turbulent flow of this mixture.

BRIEF DESCRIPTION OF THE DRAWING

Other advantages will become apparent on reading the description illustrated by the accompanying drawing which represent, diagrammatically and by way of example, two embodiments and one variant of the device for carrying out the present invention.

In the drawing.

SPECIFIC DESCRIPTION

Figure 1:
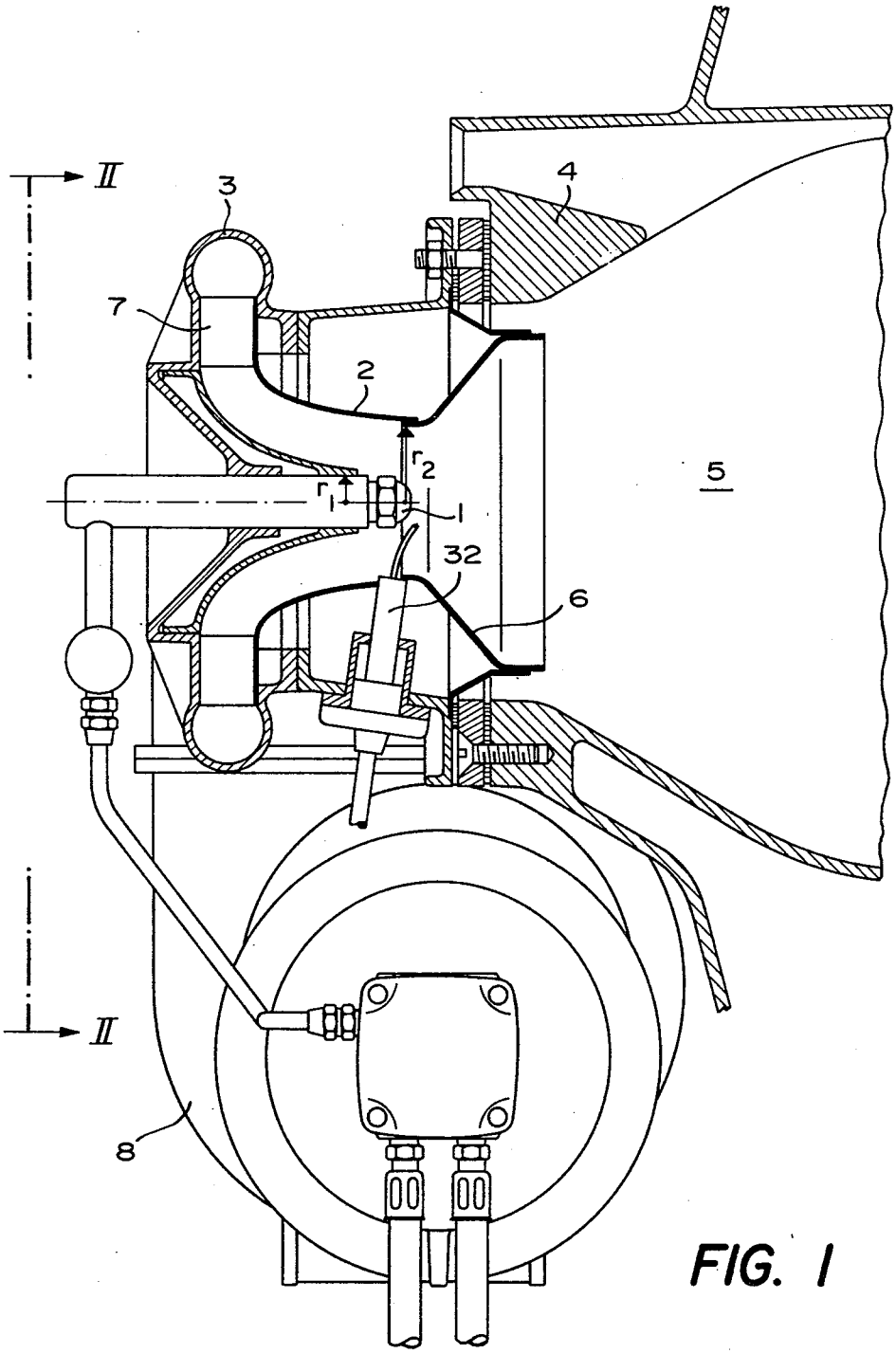
FIG. 1 is a sectional view along the longitudinal axis of the combustion chamber.
Figure 2:
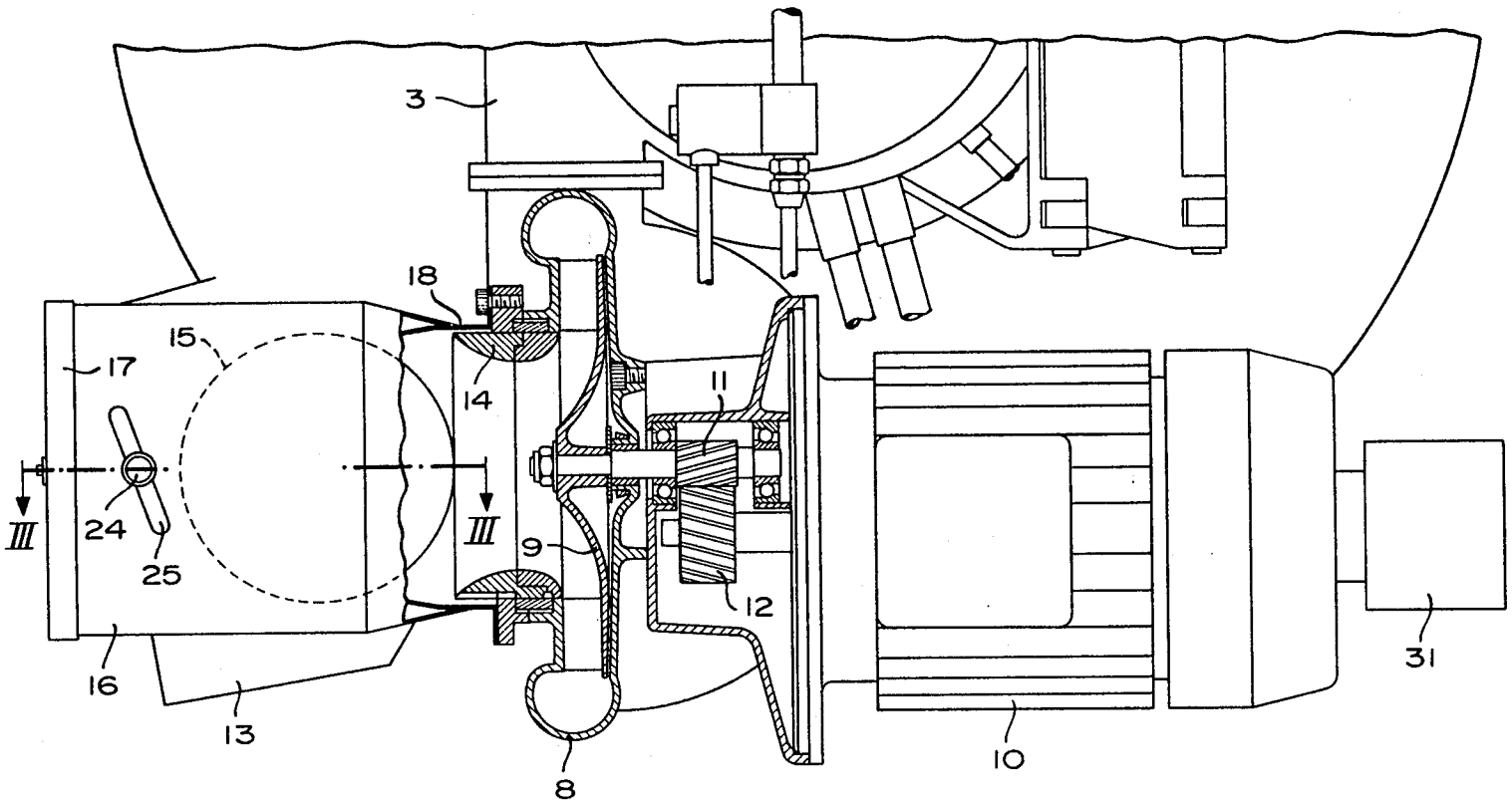
FIG. 2 is a partially sectioned elevational view along the arrows II — II of FIG. 1.

The apparatus for supplying a fluid fuel burner with a mixture of air and combustion gas, shown in FIGS. 1 and 2, is provided with a mazut (petroleum residue) injection nozzle 1 arranged coaxially in a supply pipe 2 for providing a mixture of air and combustion gas. This pipe 2 forms the outlet of a spiral tank 3 secured to the cover 4 of a combustion chamber 5, and terminates in this combustion chamber in a pot 6, the role of which will be explained hereinafter. A fixed blade member 7 forming a crown is arranged in the outlet of the spiral tank 3 and has a pitch or gradient intended to impart a helical movement to the gas mixture introduced into the combustion chamber 5.

The inlet of this spiral tank 3 communicates with the outlet of a second spiral tank 8, in which a fan-wheel 9 is mounted and is driven by a motor 10 via two helical tooth gears 11 and 12 which are integral with, respectively, the shafts of the wheel 9 and the motor 10.

Figure 3:
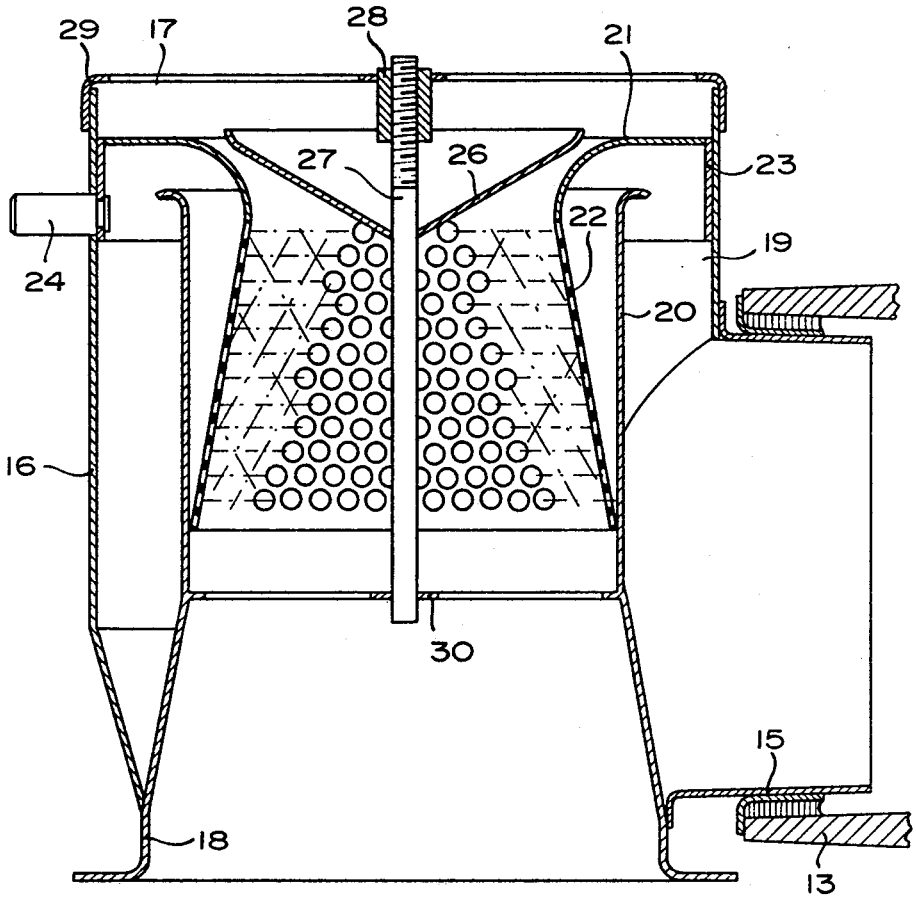
FIG. 3 is a detailed view, in section and on an enlarged scale, along the line III — III of FIG. 2.

The structure of the boiler, combined in this example with the combustion chamber 5, will not be described in detail since it is outside the scope of the invention. In order to understand the invention it is sufficient to know that in this example the boiler has two collectors for combustion gas, one of which, 13, is in communication with a first inlet 15 (FIGS. 2 and 3) of a gas mixing enclosure 16 (FIG. 3) whose second inlet 17 communicatss with the atmosphere, while the outlet 18 branches at the inlet of the second spiral tank 8 of the ventilator, which is regulated by a flow regulation sleeve 14 which can move axially.

The first inlet 15 of the enclosure communicates with an annular zone 19 formed between the external tubular envelope of the enclosure 16 and an internal wall 20 located in the extension of the outlet 18. A regulating annulus 21 carried a perforated collar 22 which widens in the direction of the outlet 18 and rests against the internal wall 20. This regulating annulus 21 is integral with a cylindrical sleeve 23 slidably mounted in the interior of the tubular envelope of the enclosure 16. The sleeve 23 carries a projection 24 which juts out beyond the enclosure 16, through a helical groove 25. The angular displacement of the sleeve 23 by means of the projection 24 enables the axial position of the sleeve 23 to be altered and the passage section between this sleeve and the adjacent end of the internal wall 20 to be regulated. The perforated tubular wall 22 serves to divide the flow of combustion gas coming from the collector 13, the purpose of which will be explained hereinafter.

The second inlet 17 of the enclosure 16, which communicates with the atmosphere, is also provided with a device for regulating the aperture formed by a cone 26 secured to a rod 27, a threaded end of which is screwed into a nut 28 integral with a perforated cover 29, and the other end of which is guided in a perforated disc 30. This cone 26 together with the regulating annulus 21 form an annular passage.

It may also be mentioned that the mazut injection nozzle 1 is fed by a pump 31 and that an ignition electrode 32 is arranged near the nozzle 1.

When the boiler is operating, the combustion gases are collected in collectors (only collector 13 is visible) situated at the outlet of convection pipes of the boiler (which are not shown), and along which these gases cool by transferring heat to the water of the boiler. In addition to the pressure reduction exerted by the draw of the flue at which the collectors branch, a second pressure reduction, more powerful than that of the flue, is created in the gas mixing enclosure 16 by the ventilator 8,9. Since this enclosure 16 communicates via its inlet 15 with the fume collector 13, the combustion gases are drawn into this enclosure 16 at the same time as the air which is drawn in through the inlet 17. The total gas volume (air plus combustion gas) drawn into the enclosure 16 as well as the air/combustion gas ratio are determined, by a flow rate previously fixed for the ventilator 8,9, by regulating means consisting of the regulating annulus 21 and the cone 26. This latter enables the total volume of aspirated gas to be regulated, whereas the annulus 21 enables the proportion of air and combustion gas admitted into the enclosure 16 to be regulated.

As has previously been said, the flow of combustion gas into the enclosure 16 via the first inlet 15 is divided into a plurality of flows during its passage through the wall of the perforated collar 22. This plurality of flows affects the air flow which also results from the pressure reduction caused by the ventilator 8,9. The formation of the plurality of flows very considerably increases the air-combustion gas interface and promotes the intermixing and turbulence of this plurality of flows. A recombination of two dense masses of gas which intermix only very partially so that the resultant mass of gas has a heterogeneous oxygen concentration constituting an instability factor in the combustion, is thus avoided. On the contrary, the penetration of a plurality of combustion gas flows into the air flow promotes the distribution of the oxygen throughout the whole mass of gas, so that the partial pressure of oxygen in the gas mixture is appreciably constant. This uniform distribution of the oxygen ensures a maximum utilization of the available oxygen and enables the amount of air to be reduced so as to approach the stoichiometric value. It is found that with equal masses of air and recirculated gases, the stability of the combustion improves considerably in proportion to the homogeneity of the gas mixture.

This mixture, formed in the enclosure 16, is aspirated by the ventilator 8,9 which compresses it and passes it to the spiral tank 3, from which it passes into the feed pipe 2 after having passed via the fixed blade member 7 which imparts to it a helical movement around the axis of the burner. This turbulent flow ("swirl") reaches the pot 6 in which the fuel is atomized by the nozzle 1.

In order to avoid pulsations in the flow of fresh air, which would set up a pulsation phenomenon in the whole of the boiler, the pressure created in the enclosure 16 by the ventilator 8,9 is less than $-10$ mm water column. The "swirl" number, $(G_\phi/r_2 G_x)$, which is given by the ratio between the kinetic momentum flux $G_\phi$ imparted to the gas and the product of the radius of the distribution opening of the burner $r_2$ (FIG. 1) times the axial quantity movement flux $G_x$, is preferably chosen to be between 0.2 and 1.2.

The lower limit should be at least sufficient to cause a recirculation of the mixture in the interior of the turbulent flow, in the form of a toroidal vortex, while the upper limit is determined by the extent of the strike back of the flame under the effect of this toroidal vortex, which should not reach the nozzle 1.

As a reminder, and according to "Combustion Aerodynamics" mentioned previously, the kinetic momentum flux $G_\phi$ is given by the formula:

$$G_\phi = 2\pi \int_{r_1}^{r_2} \rho\, UW r^2\, dr$$

in which U is the axial velocity, W is the tangential velocity at a given point $r$, $r_1$ and $r_2$ are the internal and external radii of the annular space constituting the distribution opening of the mixture, $r_1$ being the radius of the nozzle and $r_2$ that of the neck of the burner, and $\rho$ is the density.

The axial quantity movement flux is given by the formula:

$$G_x = 2\pi \int_{r_1}^{r_2} \rho\, U^2 r\, dr + 2\pi \int_{r_1}^{r_2} Pr\, dr$$

in which P is the static pressure at a given point $r$.

Of the other factors which contribute to the quality of the combustion, the pot 6 may be mentioned again. The pot 6 contributes to the fixing of the flame in the space and increases, by its divergent shape, the toroidal volume of the vortex formed within the turbulent flow while extending it, with the result that the atomized fuel particles in this vortex pass through a larger combustion gas and air mixing zone, which increases the probability of a combination between the molecules of oxygen and fuel. The pot also serves as a radiation screen between the base of the flame and the cold wall of the boiler, maintaining a sufficient temperature at this point of the flame to promote the gasification of the fuel and its good combustion. However, it may be noted that with the cover of the boiler 4 which is shown, the presence of the pot is not absolutely essential, especially as regards arresting the flame and increasing the volume of the toroidal vortex.

Figure 5:
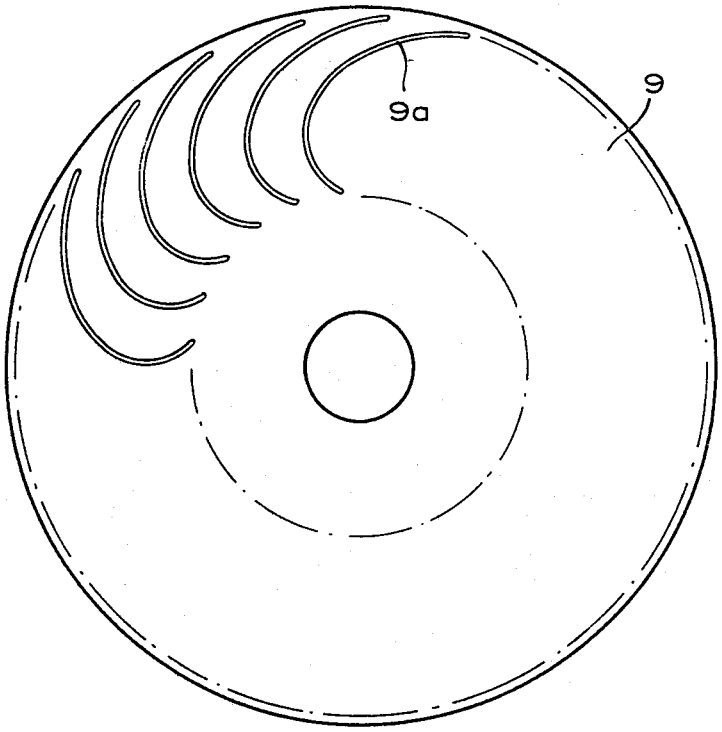
FIG. 5 is a part view of a detail of the ventilator.

Two special features of the ventilator 8,9 must also be pointed out. As shown in FIG. 5, the shape of the blade 9a of the wheel 9 of the ventilator is chosen so as to produce an acceleration of the fluid in proportion as the latter advances radially towards the spiral tank 8, so that on ignition of the boiler the particles of soot which may be recirculated with the combustion gases are swept from the surface of the blades 9a and do not accumulate thereon.

Figure 6:
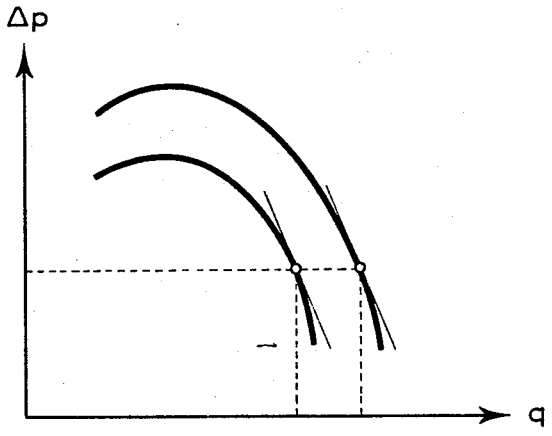
FIG. 6 is a diagram explaining the method of regulating the ventilator.

The other special feature, known per se, results from the flow rate regulating system, regulation being effected by the sleeve 14 projecting into the wheel 9, and not by throttling or constriction. The effect of the penetration by this sleeve is to alter the characteristics of the ventilator, that is to say the curve of pressure variation $\Delta p$ as a function of the flow rate $q$. However, the stability of the ventilator and thus the stability of the flame is a function of the slope of the tangent to this curve. The greater the slope the better the stability. By varying the flow rate by means of the annulus 14, the result is that the flow operates with another ventilator wheel whose $\Delta p/q$ characteristics are substantially parallel (FIG. 6) so that for the same $p$, the slope of the tangent is virtually constant. This is clearly very important for the stability of the combustion and constitutes an original method of regulating the mass flow rate of comburant fed to the burner.

Tests carried out using the device described enabled an almost instantaneous, stable, blue flame combustion to be obtained by employing a very slight excess of air with respect to stoichiometric conditions, of the order of only 5% to 10%, leading on the one hand to a practically sootless combustion, and on the other hand to a very low production of $NO_X$. Finally, the recirculation of combustion gas enables the noise level generated by the combustion to be lowered. Compared with the air mass, this recirculation is between 50% and 70% of combustion gas for a mass ratio of air and fuel close to soichiometric conditions.

As a comparison, recirculation of just combustion gas representing 50% in comparison with the mass flow rate of the air leads to an excess of air of about 30%.

"Swirl" without recirculation produces an excess of air of about 50%.

Figure 4:
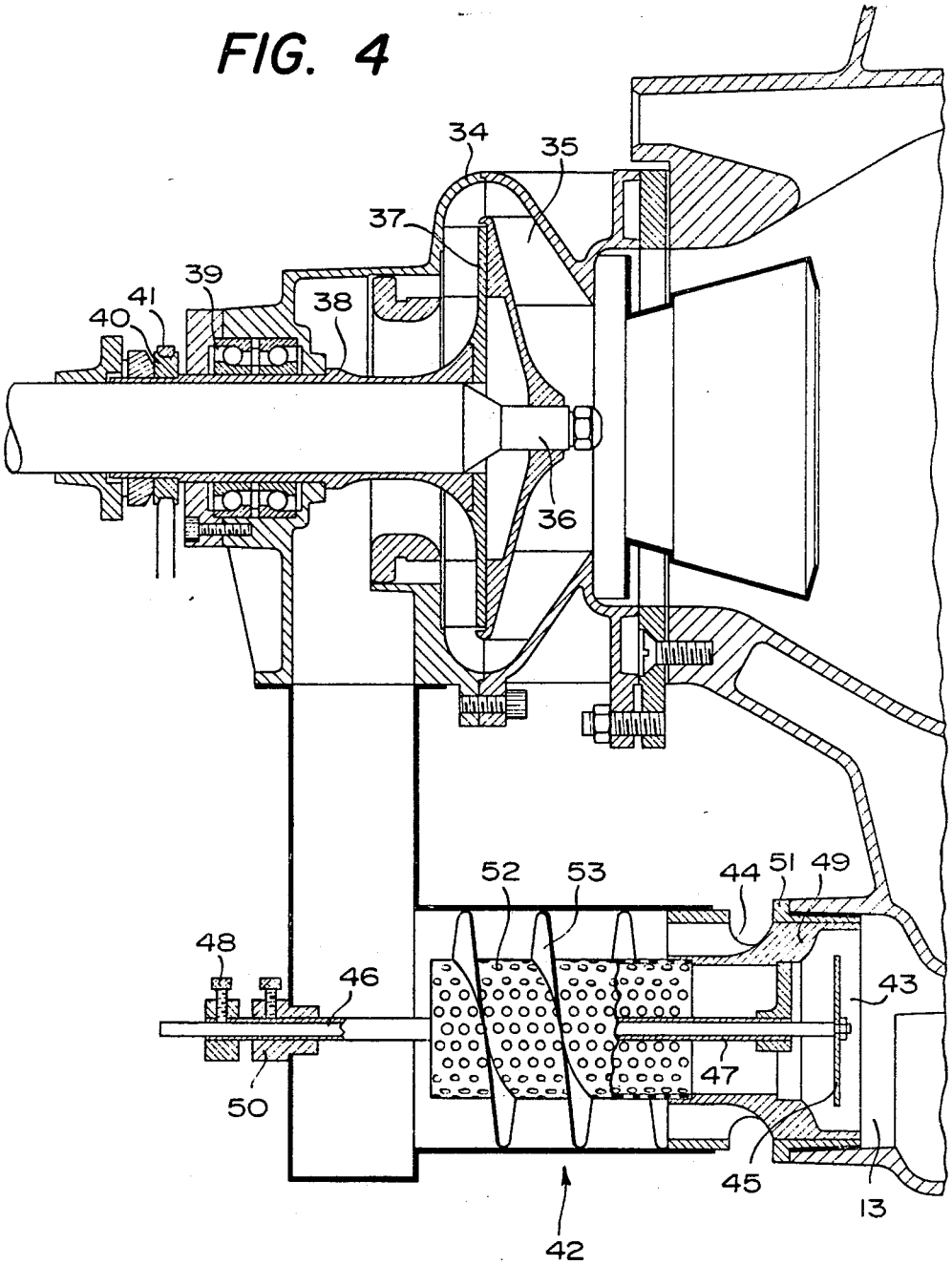
FIG. 4 is a sectional view similar to that of FIG. 1, illustrating the second embodiment.

The second embodiment illustrated in FIG. 4 differs from the first embodiment mainly in that the ventilator and turbulence generator are mounted in the same tank 34 which contains on the one hand a fixed blade 35 situated in the outlet of the tank and secured to the nozzle holder 36, and on the other hand a fan 37 coaxial with the fixed blade 35 and secured to a collar 38, connected to a drive motor (not shown) by a transmission belt 41. This tank 34 is supplied axially with a gas mixture by the pressure reduction created by the ventilator 37, via the connection between this tank 34 and the mixing device 42, which differs slightly from the device previously described.

This device comprises a first inlet opening 43 connected to the combustion gas collector 13, and second inlet openings 44 which communicate with the atmosphere. The passage section of the opening 43 is regulated by a disc 45 which can move axially and is mounted to this end on a rod 46 guided by a tube 47. A regulating screw 48 serves to fix the axial position of this rod 46 in the tube 47. This tube is integral with a collar 49 secured to one of its ends, while being slidably mounted in a socket 50 at its other end, the socket itself being integral with the enclosure containing the device 42. The collar 49 comprises two parts, one of large diameter in which is arranged the first opening 43, and slidably mounted in a tubular element 51 controlling the second opening 44, and the other of smaller diameter, to which a perforated cylinder 52 surrounded by a helical fin 53 is secured.

The air sucked in by the pressure reduction created by the ventilator 37, and which passes into the mixing device 42 via the openings 44, is subjected to a helical motion imparted by the fin 53. At the same time the combustion gases sucked in through the opening 43 are split up by the perforations in the cylinder 52 and this plurality of jets penetrates the helical air flow and produces a homogeneous mixture. This mixture is then compressed by the ventilator 37 and the fixed blades 35 impart a turbulent flow thereto, under the same conditions as in the first embodiment.

Figure 7:
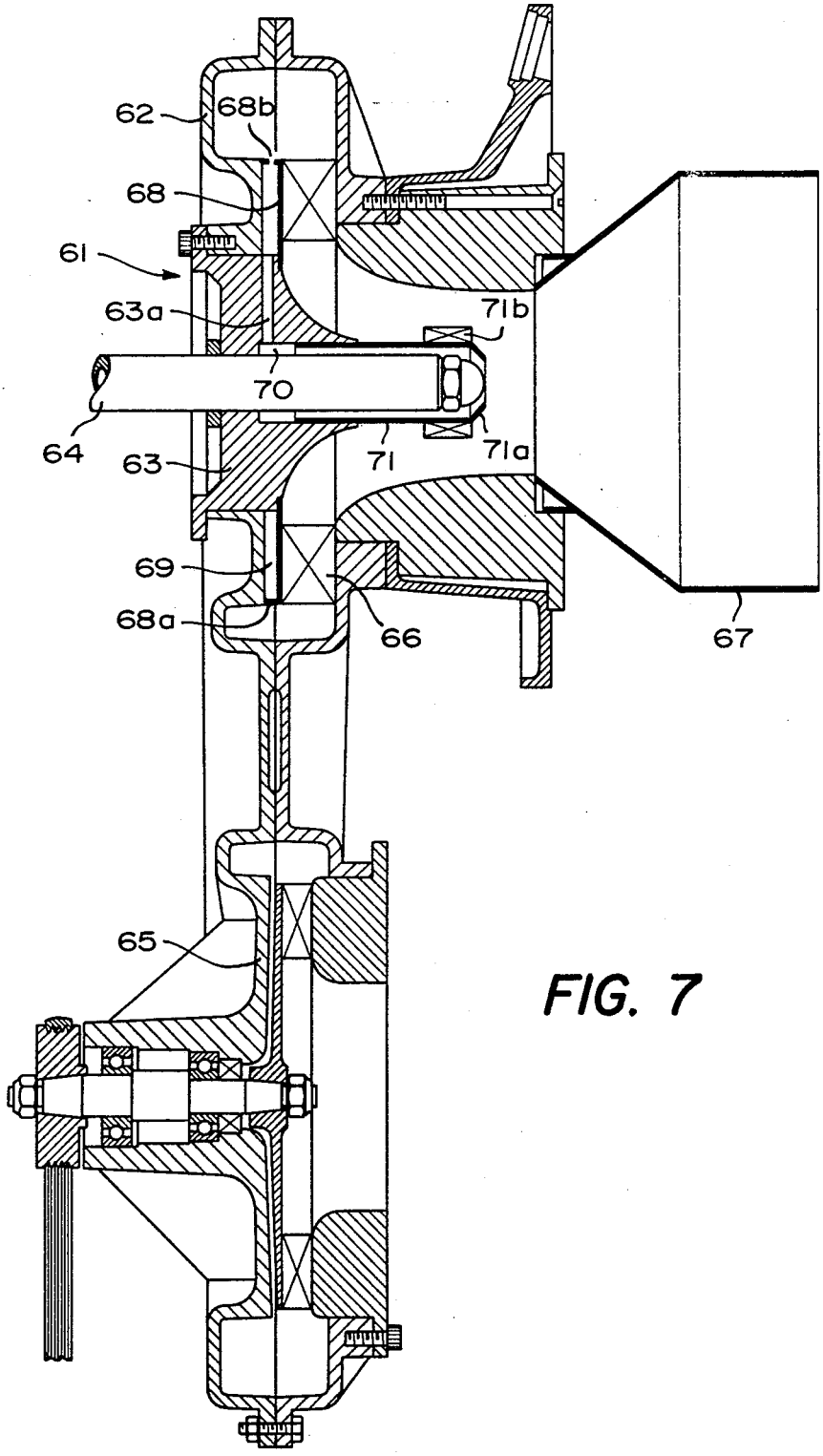
FIG. 7 is a sectional view along the longitudinal axis of the combustion chamber, of a variant of the first embodiment.

The head of the burner 61 of the variant shown in FIG. 7 comprises a spiral tank 62 which receives at its centre a nozzle carrier 63 through which passes axially an opening, in which an atomizer nozzle 64 for fluid fuel supplied from a pressurized source of fluid fuel (not shown) can be adjusted. This spiral tank is connected to the outlet of a ventilator 65 which constitutes the source of pressurized gaseous comburant. The spiral tank 62 is provided with a swirl generator and has, for this purpose, a fixed blade 66 whose vanes are orientated as a function of the intensity or number of swirls desired. This blade 66 controls access to the central distribution opening of the tank 62, concentric with the nozzle 63.

This distribution opening connects the spiral tank 62 to a flame pot or box 67 located at the inlet to the combustion chamber, the boundaries of which are not shown in the drawing.

The blade 66 is integral with a disc 68 secured to the nozzle carrier 63 whose circumference has a flange **68*a* which extends up to the face of the disc 68 opposite that carrying the blade 66. This flange 68*a* bears against the housing of the tank 62, forming an annular enclosure 69 which communicates with the remainder of the tank 62 via openings 68*b* which pass through the flange 68*a***.

The nozzle carrier 63 has radial passages **63*a* for communication with an annular space 70 formed around the nozzle 64 by a disengagement effected in the nozzle carrier 63 on the one hand, and by a collar 71 which extends the nozzle carrier 63 in the direction of the combustion chamber on the other hand. This collar 71 terminates in an annular deflector 71*a* in the shape of a truncated cone, the vertex of which is located in the flame pot 67**. However, the presence of this deflector is optional, and tests have shown that good results can be obtained with a simple cylindrical collar.

Radial vanes **71*b* project from the external surface of the collar 71 at the end thereof adjacent to the deflector 71*a*. These vanes extend only over a portion of the section of the distribution opening of the tank 62**.

When the ventilator 65 supplies the spiral tank 62 with air or a mixture of air and combustion gas or with any other suitable gaseous comburant, the greater part of this comburant passes across the fixed blade 66 which creates the swirl flow around the nozzle 64. The central part of this comburant flow meets the vanes **71*b***, which have the effect of breaking up the swirl of this central part, corresponding to the place where the flow rate is greatest. The result of breaking up the central part of this flow is to lower the velocity thereof to the flammability limits of the fuel/comburant mixture. This step allows ignition to take place at the centre of the flow despite the intensity of the swirl, so that the flame "catches" at the burner.

Some of the pressurized gaseous comburant flow is withdrawn and passes to the spiral tank 62 via the pathway formed by the openings **68*b*, the radial passages 63*a* and the annular space 70, which is terminated by the annular deflector 71*a*. That portion of the pressurised gaseous comburant diverted by this pathway has the purpose of effecting an aeration of the end of the nozzle 64 in order to prevent unburnt particles of fuel or any other particles entrained in the toroidal vortex produced by the swirl from being deposited on the surface of the nozzle 64** and thereby blocking it.

We claim:

1. A process for combusting a fuel in a burner having a nozzle for dispensing a combustible fluid, a combustion chamber downstream of said nozzle, and a distribution opening upstream of said nozzle and communicating with said chamber around said nozzle, said method comprising the steps of:

(a) generating a zone of reduced pressure upstream of said opening;

(b) communicating said zone simultaneously with a source of an oxygen-containing gaseous comburant and with said chamber whereby said reduced pressure in said zone draws said gaseous comburant and recycled combustion gas from said chamber through a common duct;

(c) mixing the stream of gaseous comburant with the stream of recycled combustion gas in said duct by subdividing one of said streams into a multiplicity of flows and dispersing said multiplicity of flows in the other of said stream, thereby producing a comburant mixture with an oxygen concentration substantially less than that of said gaseous comburant;

(d) controlling the mass-flow rate of said mixture to substantially completely burn a combustible fluid supplied by said nozzle to said chamber;

(e) controlling the oxygen concentration in said mixture to slightly exceed the stoichiometric requirement of oxygen for combustion of said fluid;

(f) introducing said mixture into the combustion chamber through said opening and imparting a turbulent flow to the mixture introduced into said chamber through said opening in which the ratio between the kinetic momentum flux of the mixture and the product of the radius of said distribution opening times the axial movement quantity flux of said mixture has a value at least sufficient to produce a recirculation of said mixture within said chamber in a toroidal vortex, the latter recirculation being independent from the recirculation of combustion gas from said chamber through said duct;

(g) directing said combustible fluid from said nozzle through said toroidal vortex whereby said fluid mixes therewith; and (h) burning the mixture of said fluid and the gases of said toroidal vortex to produce said combustion gases in said chamber.

2. The process defined in claim 1 wherein said ratio is between substantially 0.2:1 and 1.2:1.

3. The process defined in claim 1, further comprising the step of feeding a portion of the mixture formed in step (c) along said nozzle to prevent blockage thereof by products recirculated in the toroidal vortex in step (f).

4. An apparatus for feeding a gaseous comburant to a burner provided with a nozzle for injecting a combustible fluid into a combustion chamber coaxial with an opening for distribution of said comburant, said combustion chamber having at least one conduit for withdrawal of combustion gases, said apparatus comprising:

a mixing vessel provided with two inlet passages and an outlet passage, one of said inlet passages being connected to said conduit, said outlet passage being connected to said opening and the other inlet passage being connected to a source of a gaseous comburant;

means for controlling the flow cross section of each of said inlet passages independently of the other;

a blower in said outlet passage ahead of said opening for generating a reduced pressure in said mixing vessel, thereby inducing said gaseous comburant and recirculated combustion gas into said vessel and for displacing the resulting mixture into said combustion chamber through said opening;

perforated partition means in said vessel between said inlet passages for subdividing the fluid flow through one of said inlet passages into a multiplicity of streams and mixing said streams with the flow through the other inlet passage to produce said mixture with a homogeneous distribution of said gaseous comburant and said recirculated combustion gas; and turbulence-generating means at said opening for imparting to said mixture the configuration of a toroidal turbulent vortex downstream of said opening and said nozzle and inducing a recirculation of gas from said chamber into said toroidal vortex independently of the recirculation through said conduit, said turbulence-generating means including an array of vanes whose orientation in conjunction with the radius of said opening creates said toroidal vortex.

5. The apparatus defined in claim 4 wherein a housing provided with two opposite axial openings is mounted coaxial with said nozzle, the opening of the housing remote from the nozzle communicating with said vessel, said housing having an upstream end receiving said blower and a downstream end provided with said vanes.

6. The apparatus defined in claim 4, further comprising means for feeding a portion of said mixture along said nozzle to prevent blocking thereof.

7. The apparatus defined in claim 6 wherein the last-mentioned means includes a sleeve formed with an annular outlet around the discharge end of said nozzle, said outlet being formed with an inwardly extending deflector.

* * * * *